United States Patent [19]

Sumino

[11] 4,434,219

[45] Feb. 28, 1984

[54] ELECTROPHOTOGRAPHIC PHOTOSENSITIVE MEMBER COMPRISING PHOTOCONDUCTIVE POWDER AND A DEIONIZED BINDER RESIN

[75] Inventor: Fumio Sumino, Kawakaki, Japan

[73] Assignee: Canon Kabushiki Kaisha, Tokyo, Japan

[21] Appl. No.: 347,629

[22] Filed: Feb. 10, 1982

[30] Foreign Application Priority Data

Feb. 24, 1981 [JP] Japan ..... 56-25856

[51] Int. Cl.[3] ..... G03G 5/10

[52] U.S. Cl. ..... 430/96; 430/135

[58] Field of Search ..... 430/84, 85, 87, 94, 430/135, 96

[56] References Cited

U.S. PATENT DOCUMENTS 4,021,237 5/1977 Kawashima et al. ..... 430/135

4,298,670 11/1981 Murai et al. ..... 430/135

*Primary Examiner*—John E. Kittle

*Assistant Examiner*—John L. Goodrow

*Attorney, Agent, or Firm*—Fitzpatrick, Cella, Harper & Scinto

[57] ABSTRACT

An electrophotographic photosensitive member comprises a photoconductive layer composed of photoconductive powders dispersed in a deionized resin.

6 Claims, No Drawings

ELECTROPHOTOGRAPHIC PHOTOSENSITIVE MEMBER COMPRISING PHOTOCONDUCTIVE POWDER AND A DEIONIZED BINDER RESIN

BACKGROUND OF THE INVENTION

1. Field of the Invention

The present invention relates to an electrophotographic photosensitive member having a photoconductive layer comprising a resin in which a photoconductive powder is dispersed, and more particularly, to an electrophotographic photosensitive member comprising a deionized resin as a resin for dispersing a photoconductive powder therein to provide improved humidity resistance.

2. Description of the Prior Art

In a photoconductive layer of an electrophotographic photosensitive member there has been used Se, organic photoconductor (OPC) or the like, vapor-deposited on a substrate as well as a paint composed of resins containing photoconductive powders such as CdS, ZnO and the like, dispersed therein, coated on a substrate.

As a binder resin, there may be used a vinyl type, acrylic type, epoxy type resin and the like, in consideration of its electrical or mechanical properties, etc.

One of the most important properties of electrophotographic photosensitive members is resistance to deterioration of chargeability in a high humidity environment. It has been presumed that such deterioration results from the presence or formation of various ions. Particularly, since inorganic photoconductive powders such as powders of CdS, ZnO, $TiO_2$ and the like, are liable to contain ions remaining from their preparation, a certain deionization treatment is required to improve the resistance to deterioration of the electrical chargeability in a highly humid environment. However, treatment of the powders alone is not always satisfactory.

SUMMARY OF THE INVENTION

It is an object of the present invention to provide an electrophotographic photosensitive member having excellent resistance to humidity.

It is another object of the present invention to provide an electrophotographic photosensitive member having excellent properties for retaining electric charges.

It is still another object of the present invention to provide electrophotographic photosensitive members having a photoconductive layer comprising a deionized resin and photoconductive powders dispersed therein.

According to the present invention, there is provided an excellent photosensitive member having resistance to humidity by preliminarily deionizing the resin which is used as a binder for the photoconductive powders.

DESCRIPTION OF THE PREFERRED EMBODIMENTS

In general, resins usually contain a certain amount of ions due to metallic catalysts used in a polymerization, a residue of surfactants, or a stabilizer composed of metallic salts which are added, and the like. Beside these, resins containing halogen such as polyvinyl chloride, copolymers of vinyl chloride and the like, have a tendency to produce halogen ions due to deteriorative decomposition by heat or light during storage. The amount of ions in these resins are remarkably small as compared with that of ions attributable to the impurities present in the photoconductive powder. Nevertheless, the effect of ions in the resins can not be neglected since the amount of the ions lowers the charge retaining property of the member at high humidity.

According to the present invention, there is obtained an improved photosensitive member so that the property for retaining electric charge does not deteriorate even at high humidity.

Since there is no ion-exchange resin in the photoconductive layer of the present invention, the electric charge retaining property of the member is not lowered and the quality of image formed is not lowered by the presence of any ion-exchange resin.

The present invention is particularly effective where a halogen-containing resin is used as a binder.

As a process for deionization treatment, there may be employed any process such as a process using cationic and/or anionic ion-exchange resin, electrodialysis, and the like.

The following is a representative deionization process.

After mixing pellets or powders of a resin with an ion-exchange resin in water, preferably pure water, for example deionized or distilled water, the resin is separated from the ion-exchange resin, completely dried in a vacuum drier, and dissolved in a given solvent to obtain a binder in a predetermined concentration.

The deionization treatment is preferably carried out to the extent that electrical conductivity of the supernatants obtained by mixing 100 grams of the treated resin in 200 $cm^3$ of pure water, for example deionized or distilled water, for one hour, becomes less than 10 $\mu v$/cm, particularly below 1 $\mu v$/cm.

The representative constructions of the photosensitive members according to the present invention can be classified into two groups: the one constructed with the substrate and the photoconductive layer, and the other constructed with the substrate, the photoconductive layer, and the insulating layer on the said photoconductive layer.

As the substrate, there may be used electrically conductive substrates, for example, metals such as Al, Cr, Mo, Au, In, Nb, Ta, V, Ti, Pt, Pd, etc. or alloys of these metals or insulative substrates such as glass, the surface of which is treated with $In_2O_3$, $SnO_2$, etc. to be electrically conductive, and synthetic resin film such as polyimide film etc. which have been treated by the vacuum vapor deposition, electron beam vapor deposition, sputtering, and so forth to desposit on its surface those metals such as Al, Ag, Pd, Zn Ni, Au, Cr, Mo, Ir, Nb, Ta, V, Ti, Pt, and so on. It is also possible to render the surface of such synthetic resin film electrically conductive by lamination of the abovementioned metals.

The shape of the substrate may be arbitrarily determined such as a cylindrical shape, web shape, planar shape, and others. In the case of the continuous high speed reproduction, it is desirable to form it in an endless belt or cylindrical shape.

Thickness of the substrate can be arbitrarily determined. In case flexibility is required of the substrate, it can be made as thin as possible within a permissible range for the substrate to sufficiently exhibit its function. In such case, however, the thickness is usually 10 microns or more from the standpoints of convenience in manufacturing the substrate, its handling, its mechanical strength, and so forth.

The resin for binding the photoconductive powder particles is usually selected from ordinary resins. The representative resins are, for example, hydrophobic resins such as polyethylene, polyester, polypropylene, polystyrene, polyvinyl chloride, polyvinyl acetate, acryl resin, silicone resin, fluorine-containing resin, vinyl chloride/vinyl acetate copolymer, vinyl chloride/vinylidene chloride copolymer, polystyrene/butadiene copolymer, and the like.

The photoconductive powder may be selected from oxides, sulfides, iodides, selenides of metals such as Zn, Hg, Al, Sb, Bi, Cd, Mo, and so forth. Examples of these compounds are: zinc oxide, cadmium, sulfide, zinc sulfide, cadmium selenide, lead oxide, arsenic sulfide, titanium oxide, zinc-titanium oxide, zinc-silicon oxide, zinc-magnesium oxide, mercury iodide, mercury oxide, mercury sulfide, indium sulfide, calcium-strontium sulfide, and the like.

The amount of the binding resin used to form the photoconductive layer preferably ranges from 0.5 to 50 parts by weight, or more particularly, from 5 to 20 parts by weight per 100 parts by weight of the photoconductive powder.

Thickness of the photoconductive layer is, in general, from 5 to 100 microns, or preferably, from 10 to 50 microns, although it depends on the kind and characteristics of the photoconductive layer to be used.

Various kinds of ordinary resins can be arbitrarily used as the resin for forming the insulating layer to be provided on the photosensitive member of the invention. Examples of such resins are: polyethylene, polyester, polypropylene, polystyrene, polyvinyl chloride, polyvinyl acetate, acryl resin, polycarbonate, silicone resin, fluorine-containing resin, epoxy resin, and the like. Thickness of the insulating layer ordinarily ranges from 0.1 to 100 microns, or preferably, from 0.1 to 50 microns.

EXAMPLE 1

100 grams of commercially available powdery resin, copolymer of vinylchloride-vinylacetate (Trade name: VMCH, manufactured by U.C.C. in U.S.A.) was dispersed in 200 $cm^3$ of deionized water having 1.12 $\mu\nu$/cm of electrical conductivity to result in increasing the electrical conductivity to 34.7 $\mu\nu$/cm.

50 $cm^3$ of a cationic ion-exchange resin (Trade name: SK-B, manufactured by Mitsubishi Kasei Co., Ltd., Japan), and an anionic ion-exchange resin (Trade name: SA-10A, manufactured by Mitsubishi Kasei Co., Ltd., Japan) were added to the water and the solution was stirred for approximately one hour. After the electrical resistance of the supernatants reached a value lower than 0.1 $\mu\nu$/cm, the vinylchloride-vinylacetate copolymer was separated from the ion-exchange resins, and dried at 70° C. for 24 hours in a vacuum dryer after demoisturing. In consideration of the fact that the deionization treatment with a cationic ion-exchange resin alone had little effect, but the deionization treatment was effective when an ion-exchange resin was used alone, it is presumed there may have been some type of acids in VMCH, as impurity. The resin of VMCH was dissolved in a solvent composed of methyl ethyl ketone (MEK)/methyl isobutyl ketone (MIBK)=½, and mixed with CdS, which was activated with Cu and Cl. The amount of the VMCH resin (as solid) in the mixture is 12 weight percent based on the amount of CdS. The mixture was subsequently passed through three roll mills so as to fully disperse CdS in the mixture.

The resultant resin composition was then spread in the thickness of 40$\mu$ on a substrate of aluminum, and dried at 70° C. for 30 minutes. A polyester film of 25$\mu$ in thickness was overlaid thereon to obtain a photosensitive member.

EXAMPLE 2

Vinylidene chloride resin (Trade name: Saran Resin, manufactured by Asahi-Dow Co., Ltd., Japan) was deionized as shown in Example 1, and was dissolved in ethylacetate to obtain a binder solution.

A photosensitive member was produced according to the procedure of Example 1 except that the film was dried at 80° C. for 30 minutes.

EXAMPLE 3

Ethylene-vinylacetate resin (Trade name: EV-210, manufactured by Mitsui Polychemical Co., Ltd., Japan) was deionized in the same manner as disclosed in Example 1, and dissolved in toluene to obtain a binder solution. A photosensitive member was manufactured according to the procedure of Example 1 except that drying of the film was effected at 80° C. for 30 minutes.

COMPARATIVE EXAMPLE

Photosensitive members were prepared with each resin which was respectively used in Examples 1, 2 and 3, without deionization treatment. The members thus formed were used as comparative test samples.

The six test samples of photosensitive members were subjected to copying effected with a photocopying machine operated by primary charging, AC decharging simultaneously with AC discharging and a blanket exposure.

The test results are shown in the Table below in consideration of the following two points:

(1) Durability for retention of electrical charge (an electrostatic contrast after repeating 10,000 cycles as compared with the initial contrast).

(2) Retention of electric charge under a highly humid condition (an electrostatic contrast after repeating 1,000 cycles under 100% humidity as compared with the initial contrast).

As clearly seen from the table, it is recognized that durability for retaining electric charge is little affected by the deionizing treatment while the electric charge retaining property under a high humid condition is remarkably affected by the deionization of the binder.

TABLE

| | Binder | | | | | |
|---|---|---|---|---|---|---|
| Properties | VMCH deionizing treatment | VMCH Ref | Saran Resin deionizing treatment | Saran Resin Ref | EV-210 deionizing treatment | EV-210 Ref |
| Primary electrostatic contrast | 600 | 590 | 500 | 480 | 520 | 510 |
| (1) | 580 | 580 | 450 | 450 | 490 | 500 |
| Property for retaining | (96%) | (98%) | (90%) | (93%) | (95%) | (98%) |

TABLE-continued

| Properties | Binder | | | | | |
|---|---|---|---|---|---|---|
| | VMCH deionizing treatment | VMCH Ref | Saran Resin deionizing treatment | Saran Resin Ref | EV-210 deionizing treatment | EV-210 Ref |
| electric charge (2) | 432 (72%) | 300 (51%) | 220 (43%) | 130 (28%) | 180 (35%) | 170 (33%) |
| Property for retaining electric charge in high humidity | | | | | | |

What I claim is:

1. An electrophotographic photosensitive member which comprises a photoconductive layer composed of photoconductive powders dispersed in a deionized resin.

2. An electrophotographic photosensitive member according to claim 1 wherein the deionized resin possesses the property such that an electrical conductivity of a supernant which is obtained by mixing 100 grams of the said resin with 200 $cm^3$ of a pure water for one hour, is lower than 10 $\mu v/cm$.

3. An electrophotographic photosensitive member according to claim 1, wherein the photoconductive powder is made of CdS.

4. An electrophotographic photosensitive member according to claim 1, wherein the resin is deionized with an ion-exchange resin.

5. The electrophotographic photosensitive member according to claim 1 wherein the resin is a binder resin containing halogen having a tendency to produce halogen ions under the influence of heat or light or both.

6. An electrophotographic photosensitive member including a photoconductive layer which layer comprises photoconductive particles dispersed in a resin binder, said resin binder formed from a material having a tendency to reduce the photoconductive properties of said photoconductive layer under the influence of heat, light or both, said resin binder being formed by washing the resin binder material in an aqueous solution containing at least one type of ion exchange resin to solubilize any ionic impurities from the surface of said resin binder material, and then separating said binder material from said solution, wherein said electrophotographic photosensitive member is rendered stable against deterioration of its photoconductive properties due to temperature and humidity effects.

* * * * *